United States Patent [19]

Boosman

[11] 4,082,229

[45] Apr. 4, 1978

[54] WATER POWERED WASTE DISPOSAL UNIT

[75] Inventor: Frank Carlisle Boosman, Poway, Calif.

[73] Assignee: Piranha Products, San Diego, Calif.

[21] Appl. No.: 780,719

[22] Filed: Mar. 24, 1977

[51] Int. Cl.[2] ..... B02C 18/40

[52] U.S. Cl. ..... 241/46 B; 241/100.5; 241/257 G; 91/308; 91/318; 91/339; 92/121

[58] Field of Search ..... 241/46, 46 A, 46 B, 241/100.5, 257 G, DIG. 15; 91/308, 318, 327, 339; 92/120, 121

[56] References Cited

U.S. PATENT DOCUMENTS

| | | | |
|---|---|---|---|
| 1,155,998 | 10/1915 | Domizi | 91/339 |
| 1,952,690 | 3/1934 | Strom, Sr. | 91/308 |
| 2,070,720 | 2/1937 | Ernst | 91/308 |
| 2,428,420 | 10/1947 | Green | 241/257 G |
| 2,537,680 | 1/1951 | Kupiec et al. | 91/318 |
| 2,950,065 | 8/1960 | Smith et al. | 241/257 G |
| 3,700,178 | 10/1972 | Verley | 241/46 B |

*Primary Examiner*—Granville Y. Custer, Jr.
*Attorney, Agent, or Firm*—Brown & Martin

[57] ABSTRACT

A waste disposal unit having cutters which are driven with a rotary reciprocating motion by a water powered piston moving in a toroidal chamber. An automatic servo controlled valve, responsive to differential pressure on opposite sides of the piston, reverses the piston direction at the end of a stroke, or when an obstruction is encountered. The driving water is exhausted into the cutting chamber to flush waste material through the stacked cutters, which are arranged to reduce the waste material progressively to small particles.

3 Claims, 12 Drawing Figures

WATER POWERED WASTE DISPOSAL UNIT

BACKGROUND OF THE INVENTION

Waste disposal units such as used in the kitchen are usually driven by an electric motor, which rotates one or two stage cutters at high speed with considerable noise. In addition to requiring electrical wiring, there is the hazard of having electrical connections and equipment near water. If the cutters are jammed by an obstruction, such as a bone or other hard object, the motor is stalled and may be damaged. If an overload switch is installed this must be reset, and is often not very accessible. With the type of cutters normally used it is possible for fairly large particles to pass through and the accumulation in a pipe bend can cause ultimate blockage of the drain, particularly if insufficient flush water is used.

Water driven units have been developed but have had limited cutter action and are prone to jamming. A typical example is disclosed in U.S. Pat. No. 3,700,178, which has a reversing valve actuated by the piston at each end of the stroke, so that the mechanism can be jammed in a partial stroke position.

SUMMARY OF THE INVENTION

The waste disposal unit described herein is operated entirely by water, the domestic supply having ample pressure for effective operation. A piston moving in a toroidal chamber and driven by water pressure is coupled to a stack of alternately moving and stationary cutters. The moving cutters have a reciprocating rotary motion and are provided with staggered interfitting teeth, which reduce waste material progressively to small particles. The lowermost cutter has restricted openings which will not pass any large particles, or silverware or the like which may accidentally fall into the unit.

A servo controlled valve, responsive to differential pressure on opposite sides of the piston, reverses the flow and the piston direction automatically at each end of a stroke. The automatic reversal also occurs if an obstruction jams the cutters, the cutters then oscillating with a reduced stroke until the obstruction is cut off or removed. No damage is caused to the unit by such action since the operating pressure is merely that of the available supply.

The driving water is exhausted through the valve into a manifold from where it is sprayed into the cutting chamber to flush the waste material through the cutters. The unit is quiet in operation and it has been found capable of cutting up small bones, corn cobs, and other material which would jam an electrically driven unit.

The primary object of this invention, therefore, is to provide a new and improved water driven waste disposal unit.

Another object of this invention is to provide a water driven waste disposal unit having stacked cutters driven with a reciprocating rotary motion to cut waste material into progressively smaller particles.

Another object of this invention is to provide a water driven waste disposal unit in which the driving water is used to flush the waste material through the unit.

Still another object of this invention is to provide a water powered waste disposal unit in which the cutters are automatically reversed at the end of a stroke, or at any time during a stroke when an obstruction is encountered.

A further object of this invention if to provide a water driven waste disposal unit which is quiet in operation.

Other objects and advantages will be apparent in the following detailed description, taken in conjunction with the accompanying drawings, in which.

DESCRIPTION OF THE PREFERRED EMBODIMENT

Figure 1:
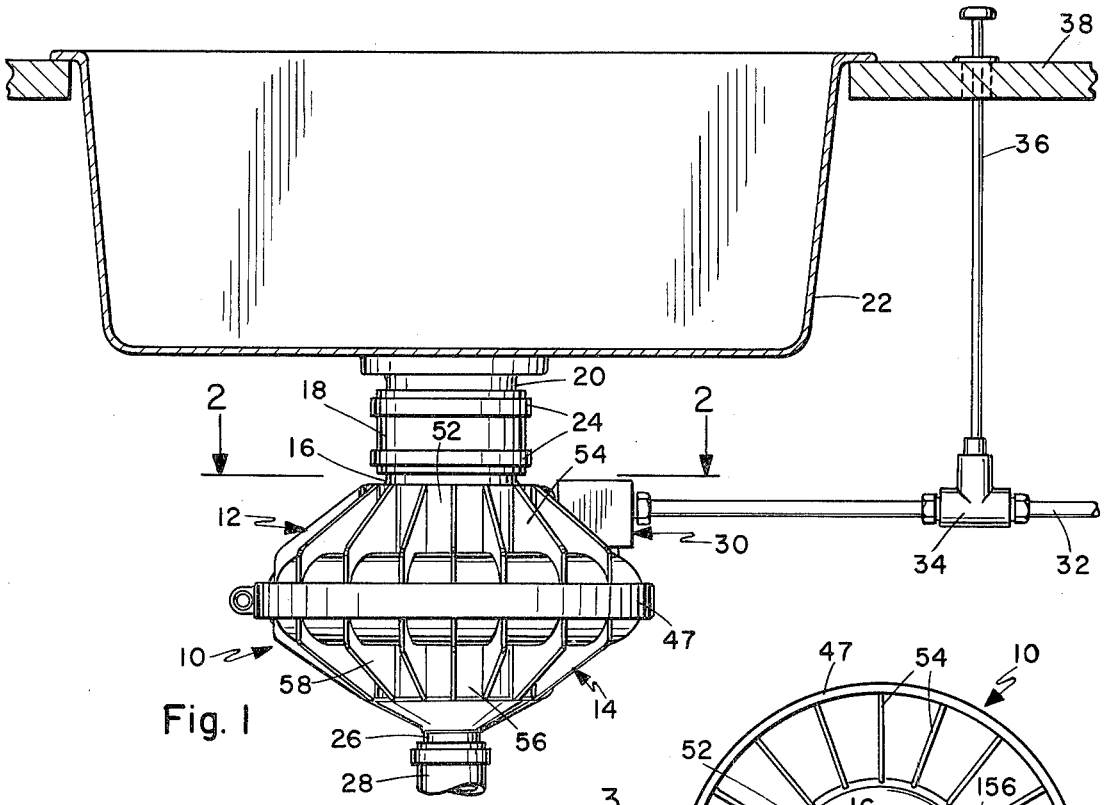
FIG. 1 is a side elevation view of the unit in a typical installation.
Figure 2:
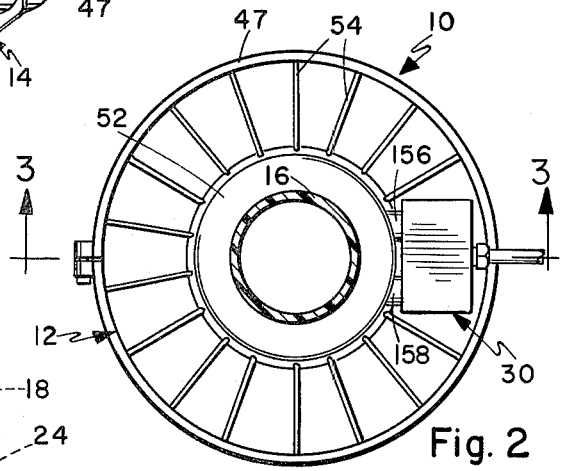
FIG. 2 is a sectional view taken on line 2—2 of FIG. 1.
Figure 3:
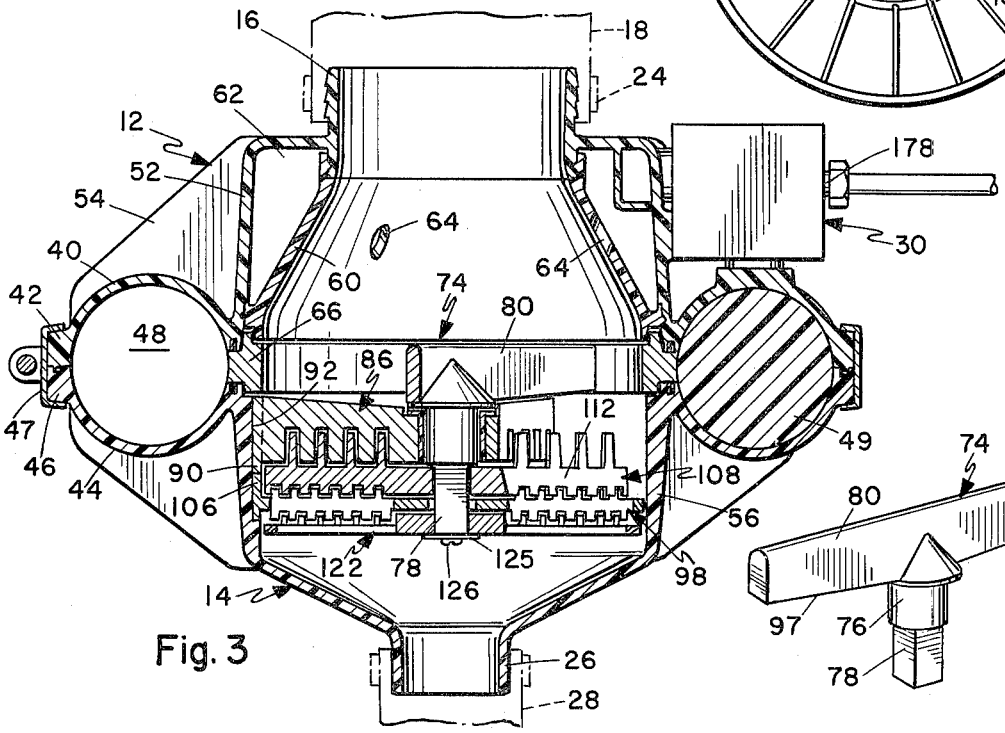
FIG. 3 is an enlarged sectional view taken on line 3—3 of FIG. 2.

The disposal unit 10 has an upper housing 12 and a lower housing 14, in which all of the mechanism is contained. Upper housing 12 has a neck 16 which is connected by a coupling 18 to the drain collar 20 of a sink 22. Clamp bands 24, or other suitable means, secure the coupling 18 with a watertight connection. Lower housing 14 has a drain outlet 26 which is connected to a drain pipe 28. The unit is light in weight and can be suspended from the conventional drain collar 20, although additional support may be used if desired.

A control valve unit 30 is mounted on upper housing 12 and is coupled to a water supply line 32 through a valve 34. An actuating rod 36 extends from valve 34 through the counter surface 38 alongside the sink, or to any other convenient position, for turning the disposal unit on and off.

Figure 8:
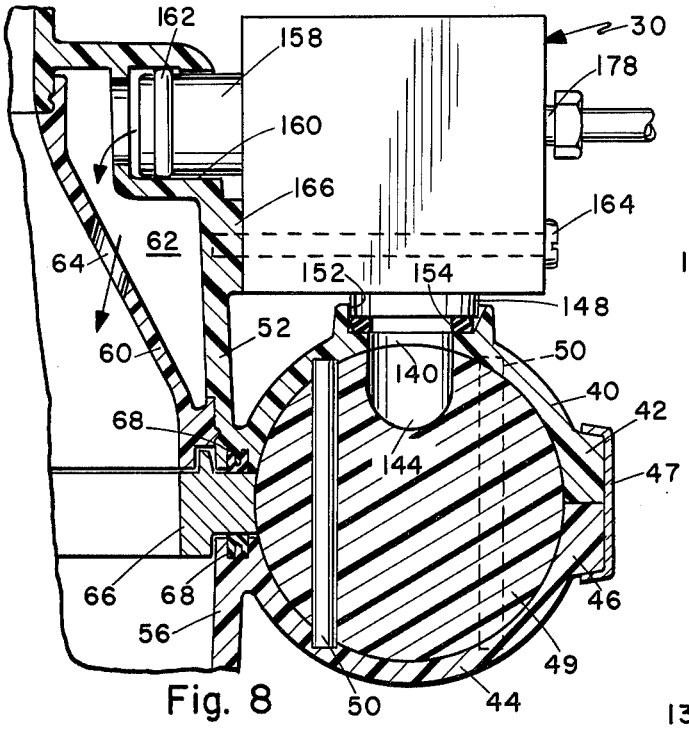
FIG. 8 is an enlarged sectional view taken on line 8—8 of FIG. 5.

Upper housing 12 has a toroidal portion 40 with a peripheral flange 42, and lower housing 14 has a toroidal portion 44 with a peripheral flange 46. The housings are secured together by a channelled clamp band 47 fitted over the flanges 42 and 46, the toroidal portions combining to form a toroidal chamber 48. A stop plug 49 closes the toroidal chamber 48 and is held in place by lock pins 50, which are inset into housings 12 and 14, as in FIG. 8.

The upper housing 12 has a substantially cylindrical main body 52, to which the toroidal portion 40 is braced by radial reinforcing fins 54. Lower housing 14 has a similar cylindrical body 56 with reinforcing fins 58 extending to toroidal portion 44. Inside the upper body 52 is a downwardly diverging shower cone 60, extending from neck 16 to the inner periphery of the toroidal portion 40. A manifold chamber 62 is enclosed between body 52 and shower cone 60, the shower cone having spray ports 64 opening downwardly from the manifold.

The inner periphery of the toroidal chamber 48 has an annular gap in which is a rotatable drive ring 66, sealed to the upper and lower toroidal portions by seal rings 68. As illustrated, the seal rings are of channelled cross section, which has been found most effective to prevent transverse and circumferential leakage with minimum friction. A piston 70, with piston rings 72, slides in the toroidal chamber 48 and is coupled through drive ring 66 to the cutter assembly, as hereinafter described. Stop plug 49 has resilient bumpers 73 on opposite sides to cushion the piston 70.

Figure 4:
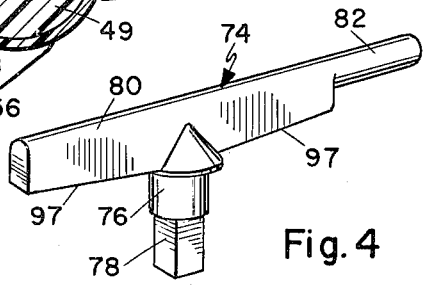
FIG. 4 is a perspective view of the first stage drive cutter.

The stacked cutter assembly, as illustrated, includes three movable and two fixed cutters in alternate arrangement, but more or less cutters could be used if desired. The first, or drive cutter 74, shown in FIG. 4, has a cylindrical post 76 with an extended lower boss 78 of square or otherwise non-circular cross section. On the upper end of post 76 is a cutter bar 80 which extends diametrically across drive ring 66. One end of the cutter bar 80 has a drive pin 82, which projects through drive ring 66 and into a socket 84 in piston 70, making the drive connection between the piston and the cutters.

Immediately below drive cutter 74 is a fixed cutter 86 having radial shear blades 88, three blades being indicated. Cutter 86 has lugs 90 at the outer ends of the blades which seat in sockets 92 in lower housing body 56 to hold the cutter against rotation. Cutter 86 has a central hub 94 with a bushing 95, which acts as a bearing for drive cutter post 76. The upper surfaces 96 of shear blades 88 and the lower faces 97 of cutter bar 80 are flat and pass closely for the initial shearing action on the waste material.

Figure 9:
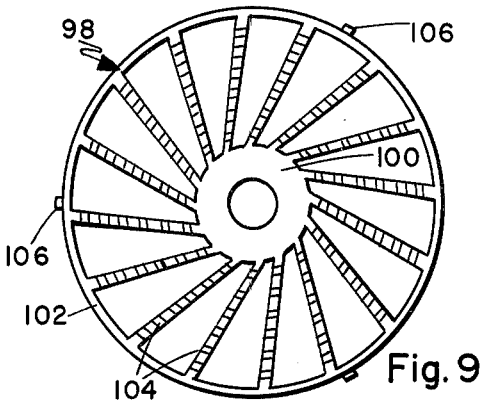
FIG. 9 is a top plan view of the intermediate stationary cutter in the stack.

Spaced below cutter 86 is another fixed cutter 98 having a central hub 100 and a peripheral ring 102, with a plurality of shear blades 104 therebetween, as in FIG. 9. Ring 102 has lugs 106 which fit into sockets 92 and space the two fixed cutters 86 and 98. Shear blades 104 are each inclined relative to a radius from hub 100, to provide a slicing rather than perpendicular shearing action.

Figure 5:
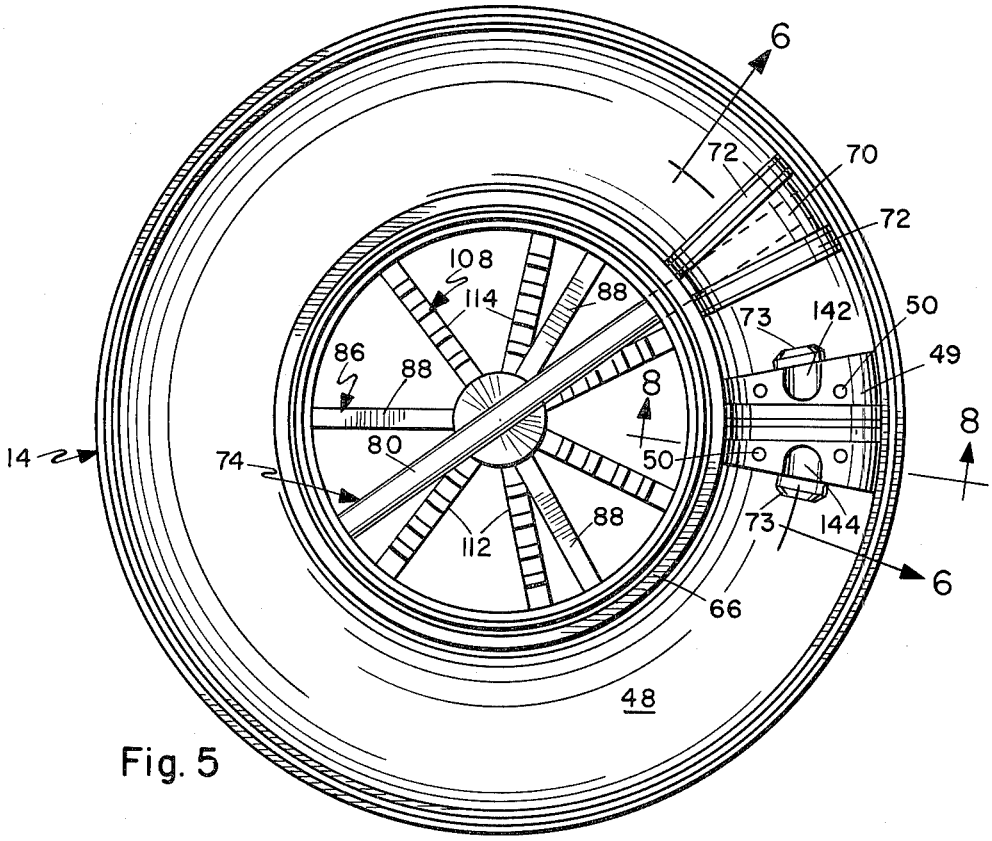
FIG. 5 is a top plan view of the unit with the upper housing removed.
Figure 6:
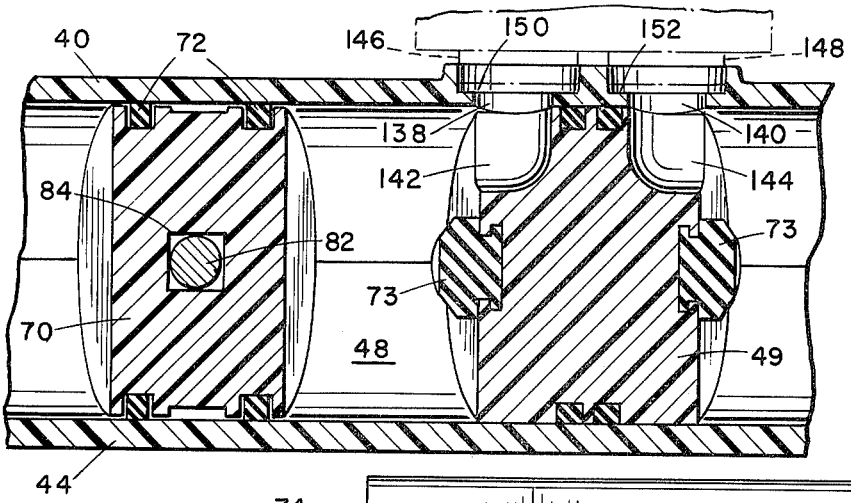
FIG. 6 is an enlarged sectional view taken on line 6—6 of FIG. 5.

Between cutters 86 and 98 is a rotary cutter 108 having a hub 110 keyed to square boss 78 to rotate with drive cutter 74. Extending from hub 110 are radial cutting blades 112, FIG. 5 indicating seven such blades. It should be noted that in FIG. 5, only cutters 74, 86, and 108 are shown for clarity. On the upper face of each cutting blade 112 are radially spaced upwardly projecting teeth 114, which pass closely through corresponding spaced slots 116 in shear blades 88 of fixed cutter 86. On the lower face of each cutting blade 112 are downwardly projecting teeth 118, which pass closely between upwardly projecting teeth 120 on the shear blades 104 of fixed cutter 98.

Figure 10:
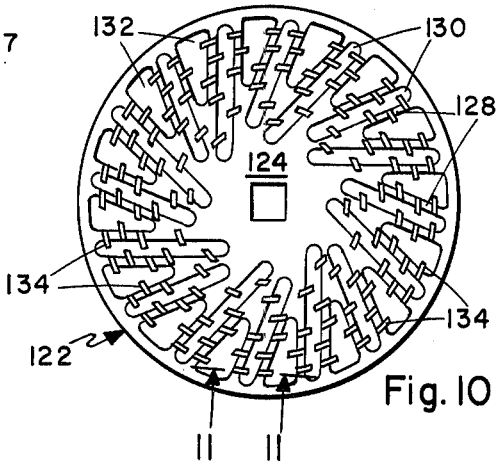
FIG. 10 is a top plan view of the lowermost rotary cutter.
Figure 11:
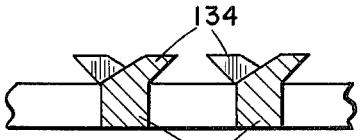
FIG. 11 is an enlarged sectional view taken on line 11—11 of FIG. 10.

Below fixed cutter 98 is a rotary cutter 122 having a central hub 124 which is keyed on boss 78. Cutter 122 is held in place by a washer 125 and a screw 126 threaded axially upwardly into boss 78. Cutter 122 has a plurality of bars 128 inclined to the radius, with slots 130 and 132 therebetween, the specific arrangement being variable. On top of each bar 128 are radially spaced teeth 134, which project over the slots 130 and 132 to minimize the openings and prevent passage of large particles, silverware and the like. Teeth 134 are circumferentially inclined, as in FIGS. 10 and 11, and pass closely between teeth 136 on the lower face of fixed cutter 98 with a shredding action.

Figure 7:
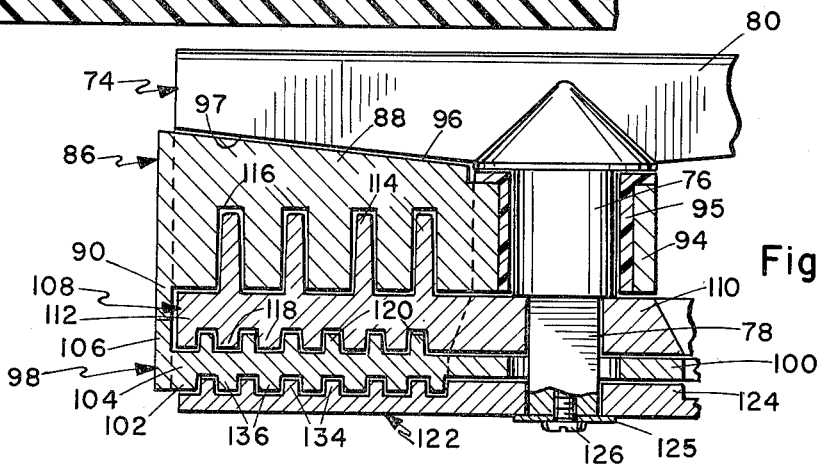
FIG. 7 is an enlarged sectional view, similar to a portion of FIG. 3, showing the cutter stack.

It should be noted that FIG. 7 shows the teeth of the various cutters intermeshed for illustrative purposes only. The cutters all have different numbers of blades so that the shearing action between cutters is staggered, that is, the cutters would never all meet simultaneously as shown. In this way the load is distributed more evenly throughout the cutting action.

The toroidal portion 40 has a pair of inlets 138 and 140 at the position of stop plug 49, the stop plug having channels 142 and 144 which connect the respective inlets to the toroidal chamber 48 on opposite sides of the stop plug. Valve unit 30 has a pair of supply outlets 146 and 148 which seat into sockets 150 and 152 of inlets 138 and 140, respectively, and are sealed by seal rings 154. Valve unit 30 also has a pair of exhaust outlets 156 and 158, which plug into sockets 160 in housing body 52, the sockets opening into manifold chamber 62. Exhaust outlets 156 and 158 are sealed in sockets 160 by O-rings 162, or the like. The valve unit is attached by inserting the exhaust outlets in sockets 160 and seating the supply outlets down into sockets 150 and 152. Screws 164 then secure the valve unit to a thickened portion 166 of body 52, as in FIG. 8.

Figure 12:
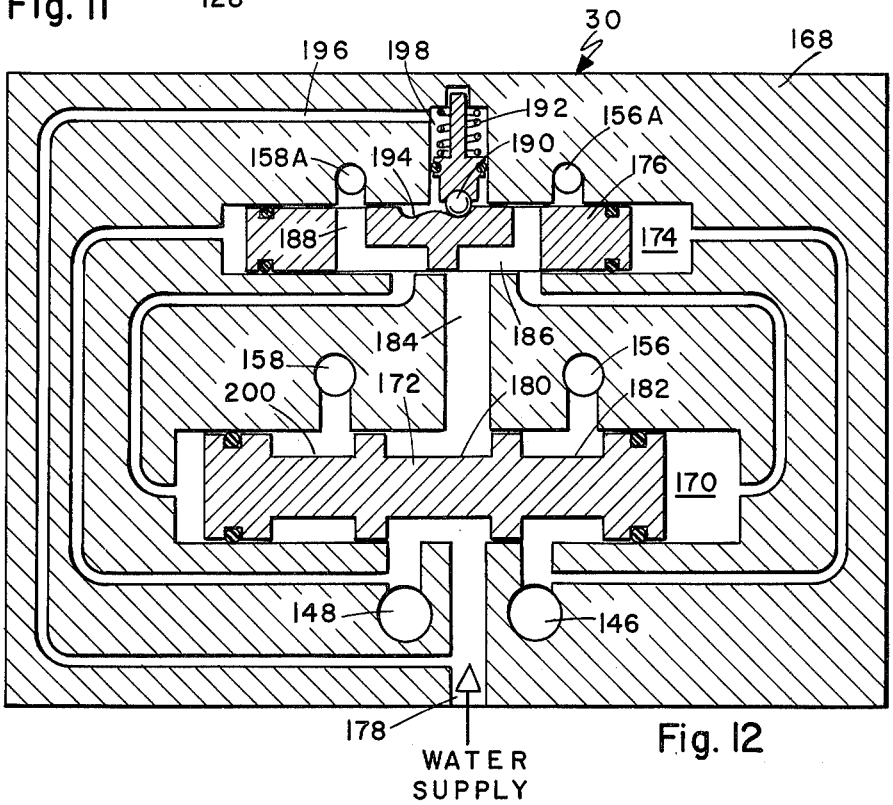
FIG. 12 is a schematic view, in section, of the automatic reversing valve.

The mechanism of valve unit 30 is illustrated schematically in FIG. 12, for ease of understanding. The structure and assembly techniques for such a unit are well known.

Valve body 168 contains a large cylinder 170 in which is an axially slidable control spool 172, and a small cylinder 174 in which is a slidable servo spool 176. In relation to FIG. 5, the spools are positioned to drive piston 70 in a clockwise direction. From water supply inlet 178, water passes through the central channel 180 in spool 172 to the supply outlet 148, which feeds into toroidal chamber 48. Water from the other side of piston 70 exits through supply inlet 146, which is coupled through channel 182 in the right end of spool 172 to exhaust outlet 156, opening into manifold chamber 62. In coming water pressure also passes through connecting port 184, and through channel 186 in spool 176 to the right hand end of cylinder 170, which holds spool 172 in its place. The other end of cylinder 170 is coupled through channel 188 in spool 176 to exhaust outlet 158A which is common with outlet 158.

Pressure from the supply at outlet 148 is also applied to the left hand end of cylinder 174, the other end of which is coupled to supply outlet 146, now acting as an exhaust. A pressure differential thus exists between the ends of servo cylinder 174. However, spool 176 is retained by a detent 190 preloaded by a spring 192 into a double ended detent slot 194 in the spool. A pressure tap 196 extends from the supply inlet 178 to the chamber 198 behind the detent 190 to add to the spring pressure, so that the detent is preloaded in accordance with the existing supply pressure.

During a normal stroke a back pressure is created by the resistance of the water exhausting through a restricted outlet while the supply water has a slight pressure drop through the valve unit, so the differential is insufficient to overcome the detent. As the piston 70 reaches the end of its travel and the water being pushed ahead of the piston is exhausted, the back pressure drops significantly and the supply pressure driving the piston causes a large pressure differential across the servo spool 176. Pressure from the supply inlet to the left end of cylinder 174 becomes sufficient to overcome detent 190 and drive the spool 176 to the other end of cylinder 174. Supply pressure is then applied through connecting port 184 and channel 188 of spool 176 to the left end of cylinder 170. At the same time the right end of cylinder 170 is opened to exhaust outlet 156A through channel 186. This allows control spool 172 to be driven to the right and reverses the pressure flow. The supply pressure is then connected through channel 180 to supply outlet 146 to drive the piston in the reverse direction. Supply outlet 148 then becomes the exhaust from the torodial chamber, and is connected to exhaust outlet 158 through channel 200 in spool 172.

At each end of the piston travel, reversal is automatically initiated by the pressure differential across the servo spool. Reversal will also occur if the cutters are jammed by an obstruction or object too hard to cut, resulting in a sudden increase in pressure differential on opposite sides of the piston. The action is automatic at any supply pressure, since the servo spool detent is pressure balanced to the supply. It has been found that the cutters will continue to oscillate through any length of stroke until the obstruction is eventually cut off or removed.

The exhausted water, after driving the piston, is ejected into manifold chamber 62 and sprayed through ports 64 into the cutter assembly with a flushing action. It is thus not necessary to run flush water into the unit, as with an electrical type disposal.

The unit is quiet in operation, the cutters oscillating at about 15 to 25 cycles per minute, depending on water pressure. The oscillating progressive shearing action is very powerful and a large quantity of waste can be disposed of rapidly.

While the unit can replace most electrically powered disposals, it is particularly suitable for use on marine vessels. By making the majority of the components from plastic and the cutters from stainless steel for corrosion resistance, the unit can use salt water for its operation.

Having described my invention, I now claim:

1. A water powered waste disposal unit, comprising:

a substantially cylindrical housing having an upper waste material receiving neck and a lower drain outlet;

a plurality of stacked cutters mounted in said housing, certain of said cutters being rotatable;

said housing having an annular toroidal chamber, with a stop plug blocking the chamber at one position;

a piston mounted for sliding movement around said toroidal chamber and having connection means to the rotatable cutters;

said toroidal chamber having a pair of water inlets on opposite sides of said stop plug;

a valve unit coupled to said inlets and having means for connection to a source of pressurized water;

said valve unit comprising a body having a control cylinder with a water supply inlet connected thereto, and supply outlets for connection to said toroidal chamber inlets;

said valve unit having control means for supplying water alternately to said toroidal chamber inlets to drive said piston and the connected cutters with a reciprocating rotary motion;

said control means comprising a control spool reciprocable in the control cylinder with channels for the directing supply water selectively to said supply outlets;

a servo cylinder in said body with a servo spool reciprocable therein, said serve spool having channels for directing supply water selectively to opposite ends of said control cylinder, the opposite ends of said servo cylinder being connected to said supply outlets, whereby the servo spool is responsive to differential pressure on opposite sides of said piston;

a two position detent engaging said servo spool for holding the spool at each end of its reciprocatory stroke;

and biasing means loading said detent to prevent movement of the servo spool below a predetermined pressure differential between opposite ends of the servo cylinder.

2. A water powered waste disposal unit according to claim 1, wherein said biasing means includes a pressure tap from said water supply inlet for loading the detent in relation to the supply pressure.

3. A water powered waste disposal unit according to claim 1, wherein said housing has an upper portion and a lower portion, said cutters being mounted in the lower portion;

a drive ring rotatably mounted between said upper and lower housing portions in the inner periphery of said toroidal chamber and being connected between said piston and the rotatable cutters;

annular seal rings in said upper and lower housing portions in sealing contact with the upper and lower faces of the drive ring;

said upper housing portion having an annular manifold chamber with circumferentially spaced spray ports directed toward said cutters;

said valve unit having exhaust outlets opening into said manifold chamber, with means for exhausting water from said toroidal chamber into the manifold chamber.

* * * * *